US005241736A

United States Patent [19]

Allison

[11] Patent Number: 5,241,736

[45] Date of Patent: Sep. 7, 1993

[54] METHOD OF MAKING A C-CLAMP HAVING A DRIVING HEAD

[76] Inventor: James R. Allison, 1429 Grant Ave., Woodlyn, Pa. 19094

[21] Appl. No.: 952,324

[22] Filed: Sep. 28, 1992

[51] Int. Cl.[5] ..... B21D 35/00

[52] U.S. Cl. ..... 29/469.5; 29/257; 29/DIG. 1

[58] Field of Search ..... 29/256, 257, 469.5, 29/DIG. 1; 81/10, 13; 269/182-185, 249

[56] References Cited

U.S. PATENT DOCUMENTS 1,999,537 4/1935 Fisher ..... 29/257
5,069,861 12/1991 Lagarrigue ..... 29/257 X

FOREIGN PATENT DOCUMENTS 42107 2/1888 Fed. Rep. of Germany ..... 269/186
311712 4/1919 Fed. Rep. of Germany ..... 29/257
818503 8/1959 United Kingdom ..... 269/182

*Primary Examiner*—Mark Rosenbaum
*Assistant Examiner*—Peter Dungba Vo
*Attorney, Agent, or Firm*—Leon Gilden

[57] ABSTRACT

A C-clamp having a rod head exteriorly of the C-shaped framework of the C-clamp is arranged to include a drive recess to complementarily receive a Phillips head screwdriver to enhance ease of adjusting the clamping rod of the C-clamp towards and away from the fixed clamping plate.

4 Claims, 4 Drawing Sheets

METHOD OF MAKING A C-CLAMP HAVING A DRIVING HEAD

BACKGROUND OF THE INVENTION

1. Field of the Invention

The field of invention relates to C-clamp structure, and more particularly pertains to a new and improved driving head and C-clamp apparatus wherein the same is arranged to permit ease of manipulation of the clamping rod relative to the C-clamp structure.

2. Description of the Prior Art

C-clamps of various types are utilized in the prior art and exemplified in the U.S. Pat. Nos. 4,823,636; 4,649,614; 4,582,307; 4,534,547; and 4,220,322.

The instant invention attempts to overcome deficiencies of the prior art by providing for a C-clamp arrangement having a drive member such as a Phillips head screwdriver cavity mounted within the rod head of the clamp rod to permit ease of rotation of the clamp rod relative to the framework of the C-shaped clamp, in a manner not addressed in the prior art to permit speed of manipulation of the clamp rod and in this respect, the present invention substantially fulfills this need.

SUMMARY OF THE INVENTION

In view of the foregoing disadvantages inherent in the known types of C-clamp structure now present in the prior art, the present invention provides a driving head and C-clamp apparatus wherein the same is arranged with a driving cavity mounted within the head portion of the clamping rod in a coaxially aligned relationship relative to the clamping rod to permit ease of manipulation of the clamping rod structure. As such, the general purpose of the present invention, which will be described subsequently in greater detail, is to provide a new and improved driving head and C-clamp apparatus which has all the advantages of the prior art C-clamp structure and none of the disadvantages.

To attain this, the present invention provides a C-clamp having a rod head exteriorly of the C-shaped framework of the C-clamp arranged to include a drive recess to complementarily receive a Phillips head screwdriver to enhance ease of adjusting the clamping rod of the C-clamp towards and away from the fixed clamping plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved driving head and C-clamp apparatus which has all the advantages of the prior art C-clamp structure and none of the disadvantages.

It is another object of the present invention to provide a new and improved driving head and C-clamp apparatus which may be easily and efficiently manufactured and marketed.

It is a further object of the present invention to provide a new and improved driving head and C-clamp apparatus which is of a durable and reliable construction.

An even further object of the present invention is to provide a new and improved driving head and C-clamp apparatus which is susceptible of a low cost of manufacture with regard to both materials and labor, and which accordingly is then susceptible of low prices of sale to the consuming public, thereby making such driving head and C-clamp apparatus economically available to the buying public.

Still yet another object of the present invention is to provide a new and improved driving head and C-clamp apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
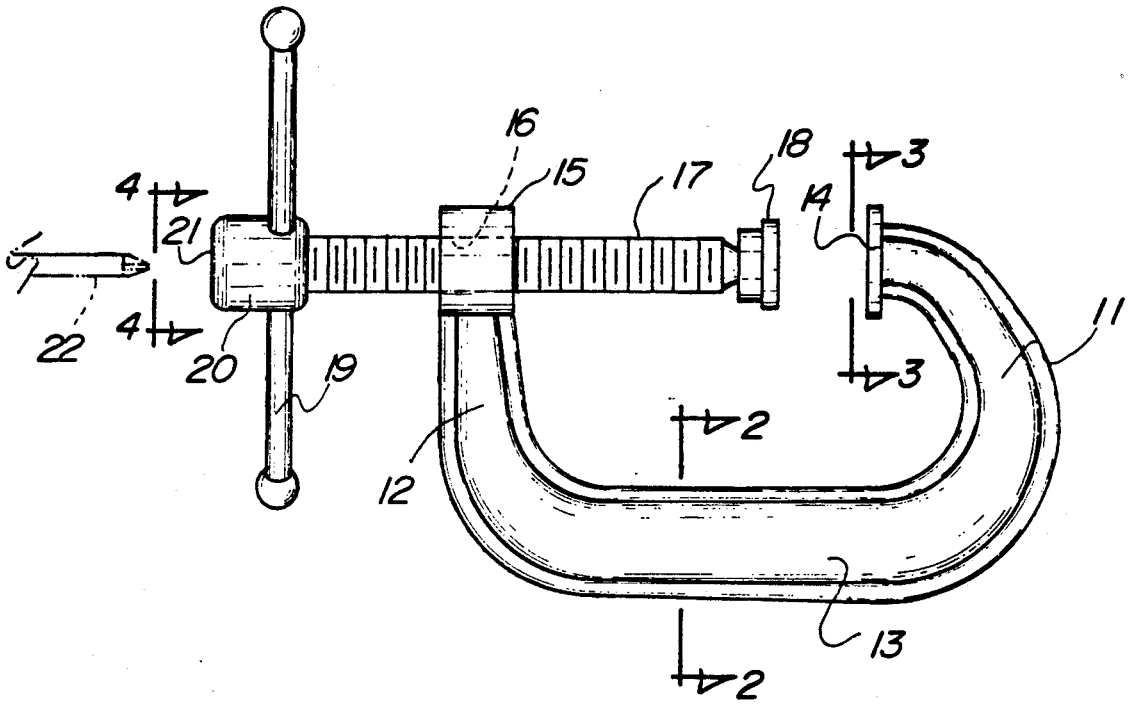
FIG. 1 is an orthographic side view, taken in elevation of the invention.
Figure 2:
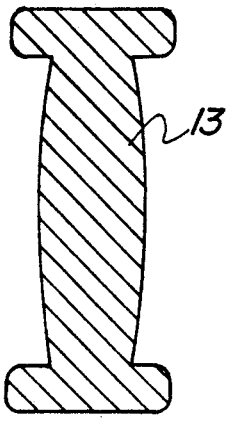
FIG. 2 is an orthographic view, taken along the lines 2—2 of FIG. 1 in the direction indicated by the arrows.
Figure 3:
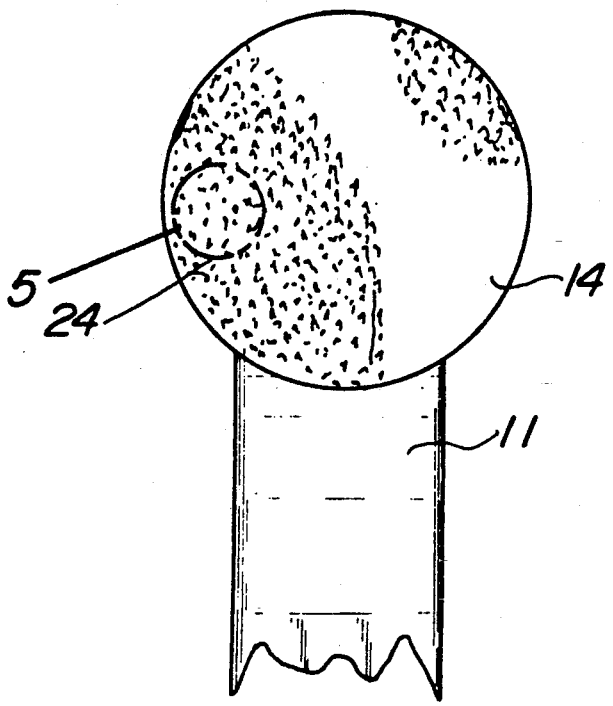
FIG. 3 is an orthographic view, taken along the lines 3—3 of FIG. 1 in the direction indicated by the arrows.
Figure 4:
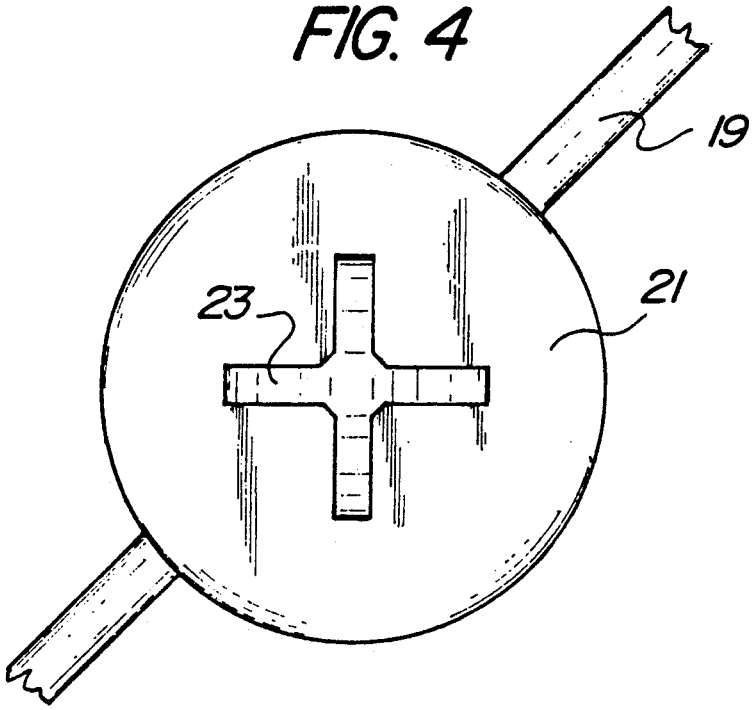
FIG. 4 is an orthographic view, taken along the lines 4—4 of FIG. 1 in the direction indicated by the arrows.
Figure 5:
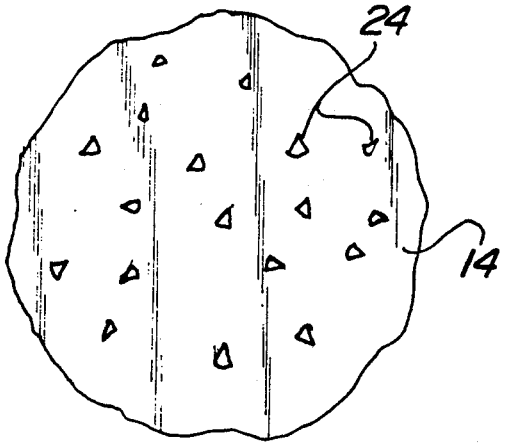
FIG. 5 is an enlarged orthographic view of section 5 as set forth in FIG. 3.
Figure 6:
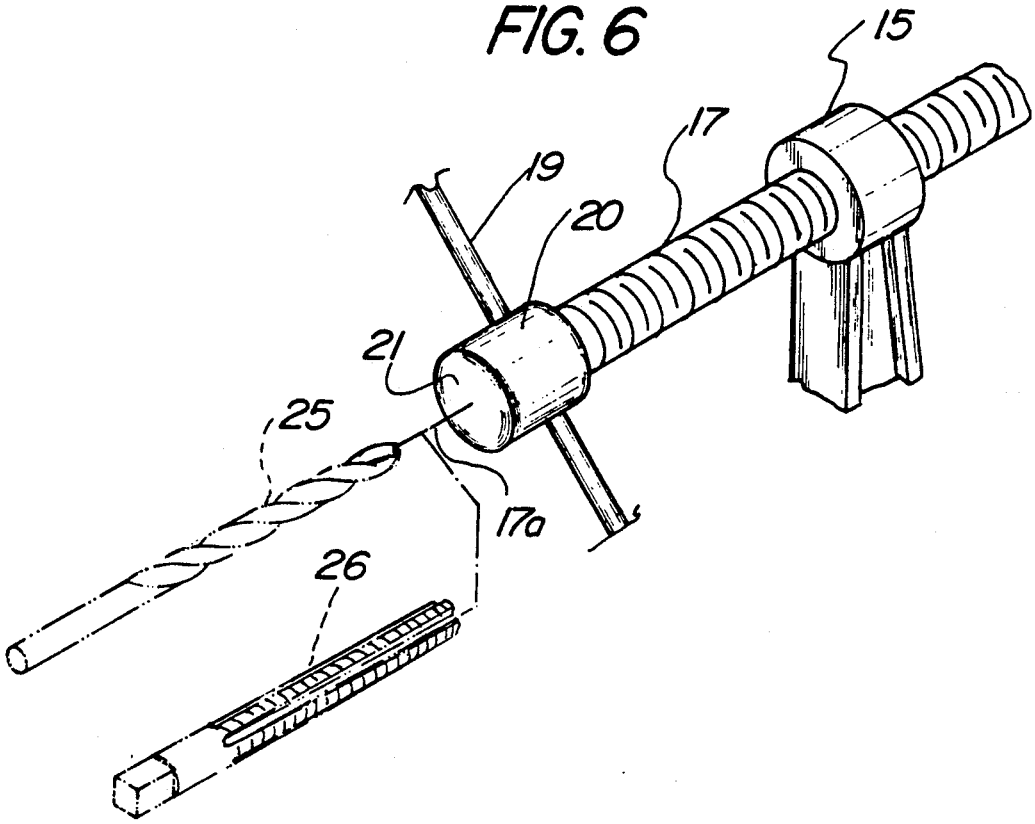
FIG. 6 is an isometric illustration indicating retrofit mounting of a drive cylinder relative to a C-clamp structure.

With reference now to the drawings, and in particular to FIGS. 1 to 8 thereof, a new and improved driving head and C-clamp apparatus embodying the principles and concepts of the present invention and generally designated by the reference numeral 10 will be described.

More specifically, the driving head and C-clamp apparatus 10 of the instant invention essentially comprises a C-clamp having a first arm 11 spaced from a second arm 13 mounted at opposed ends of a connecting shank 13. A fixed clamping plate 14 is mounted to the first arm 11, with a collar 14 mounted to the second arm 12 coaxially aligned relative to the clamping plate 14. An internally threaded bore 16 is directed through the collar 15 coaxially aligned relative to the fixed clamping plate 14, with an externally threaded clamping rod 17 threadedly directed through the internally threaded bore 16. A clamping rod plate 18 is pivotally mounted to the clamping rod 17 in confronting relationship relative to the fixed clamping plate 14. A rod head 20 is mounted to the clamping rod 17 at an opposed end thereof relative to the rod plate 18. The rod head 20 includes a sliding cross bar 19 slidably directed through the rod head 20 orthogonally oriented relative to the clamping rod 17 to permit ease of manipulation of the clamping rod 17 relative to the collar 15.

The rod head 20 includes a rod head end wall 20 orthogonally oriented relative to the clamping rod 17 facing exteriorly of the clamping rod, with a Phillips head screwdriver cavity 23 mounted within the rod head end wall 21 to accommodate a Phillips head screwdriver 22. In this manner, ease of manipulation of the clamping rod 17 is effected relative to the orientation of the rod plate 18 and the clamping plate 14. As required, a matrix of projecting spikes 24 are mounted about the fixed clamping plate 14 to enhance grasping of various objects between the clamping plate 14 and the rod plate 18.

Figure 7:
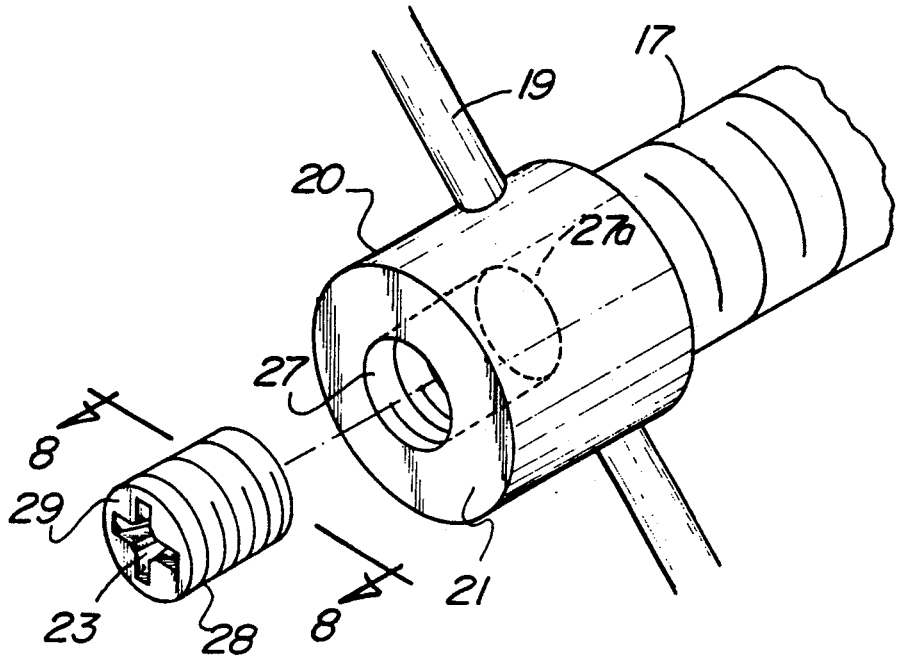
FIG. 7 is an isometric illustration indicating positioning of the drive cylinder plug relative to the C-clamp drive head.
Figure 8:
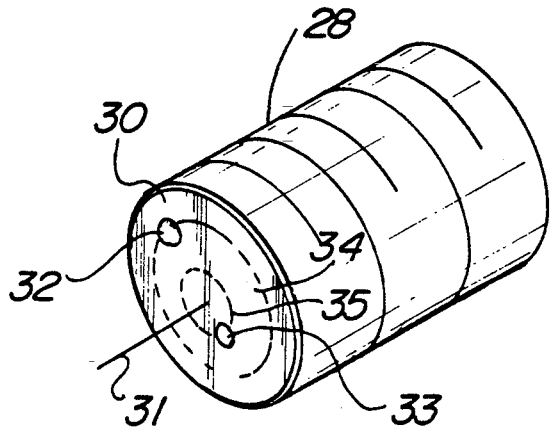
FIG. 8 is an isometric view, taken along the lines 8—8 of FIG. 7 in the direction indicated by the arrows.

Retrofit of a drive cavity 23 includes utilization of a drill bit 25 and drilling a bore into the rod head end wall 21 coaxially aligned with the clamping rod axis 17*a*. Further, a thread tap 26 is directed into a bore formed within the rod head end wall 21 to provide for an internally threaded head bore 27 as a resultant product, as indicated in FIG. 7. An externally threaded drive plug 28 is provided, having a drive plug axial length substantially equal to the head bore's axial length, with the drive plug including a first end wall 29 spaced from and parallel a second end wall 30 orthogonally oriented relative to the drive plug's axis. The first end wall 29 is provided with the Phillips head cavity 23. It should be understood that alternatively, a socket cavity or a socket hex head may be projected from the first end wall 29 as an alternative.

The drive plug second end wall 30 includes a first and second adhesive capsule 32 and 33 mounted at respective first and second radial spacings relative to the drive plug axis 31, with the first radial spacing spaced at a greater distance than the second radial spacing. In this manner, a first adhesive circle 34 and a second adhesive circle 35 are subtended by the respective first and second adhesive capsules 32 and 33 when directed into the head bore 27 and a contact is effected with the head bore's floor 27*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of making a C-clamp, comprising,
   providing a C-clamp to include a connecting shank, with the connecting shank including a first arm and a second arm, with the first arm spaced from the second arm, and providing the first arm with a fixed clamping plate, and providing the second arm with a collar,
   threading the collar thereby forming an internally threaded bore therethrough and providing an externally threaded clamping rod threadedly directed through the internally threaded bore, and the clamping rod symmetrically oriented about a rod axis, and the rod axis orthogonally oriented relative to the fixed clamping plate,
   providing a sliding cross bar, and orienting the sliding cross bar orthogonally relative to the rod axis directed through the rod head,
   providing the rod head with an end wall, and the end wall orthogonally oriented relative to the rod axis projecting exteriorly of the clamping rod,
   drilling a head bore into the rod head coaxially aligned along the rod axis,
   threading the drilled bore, wherein the head bore is symmetrically oriented about the rod axis, and the head bore has a predetermined height,
   providing an externally threaded drive plug having a plug height equal to the predetermined height, with the drive plug having a first end wall and a second end wall, said head bore having a head bore floor spaced from the rod head end wall said predetermined height, and
   threading the drive plug into the head bore to effect contiguous communication between the second end wall and the head bore floor.

2. A method as set forth in claim 1 further including directing a drive cavity into the first end wall having a Phillips head configuration.

3. A method as set forth in claim 1 including the step of positioning a first adhesive capsule and a second adhesive capsule on the second end wall prior to directing the drive plug into the head bore.

4. A method as set forth in claim 3 wherein forming the drive plug symmetrically about a drive plug axis and positioning the first adhesive capsule on the second end wall a first radial spacing relative to the drive plug axis and positioning the second adhesive capsule on the second end wall a second radial spacing, with the second radial spacing less than the first radial spacing, and subtending a first adhesive circle on the second end wall and the second adhesive circle on the second end wall concentrically about the drive plug axis when the drive plug is directed into the head bore.

* * * * *